US006257531B1

(12) United States Patent
Penner

(10) Patent No.: US 6,257,531 B1
(45) Date of Patent: Jul. 10, 2001

(54) ERGONOMIC WORKSTATION AND KEYBOARD SUPPORT

(76) Inventor: Phillip R. Penner, 17705 S. Western Ave. #77, Gardena, CA (US) 90248

( * ) Notice: Subject to any disclaimer, the term of this patent is extended or adjusted under 35 U.S.C. 154(b) by 0 days.

(21) Appl. No.: 09/347,885

(22) Filed: Jul. 6, 1999

Related U.S. Application Data

(60) Provisional application No. 60/091,124, filed on Jun. 29, 1998.

(51) Int. Cl.[7] ..... B68G 5/00; B43L 15/00

(52) U.S. Cl. ..... 248/118; 248/118.1; 248/918

(58) Field of Search ..... 248/118.3, 276.1, 248/118.1, 286.1, 291.1, 118, 284.1, 292.12, 918; 108/93, 45

(56) References Cited

U.S. PATENT DOCUMENTS 4,776,284 * 10/1988 McIntosh ..... 248/281.1
5,513,579 * 5/1996 Allan ..... 108/93
5,823,487 * 10/1998 Kirchoff et al. ..... 248/118
5,836,560 * 11/1998 Kaplan et al. ..... 248/286.1
5,915,657 * 6/1999 Ptak ..... 248/918
5,924,664 * 7/1999 Mileos et al. ..... 248/281.11
5,975,474 * 11/1999 Kaplan et al. ..... 248/284.1
6,082,552 * 7/2000 Pollock et al. ..... 248/284.1
6,098,935 * 8/2000 Kaplan et al. ..... 248/118.1

* cited by examiner

*Primary Examiner*—Anita M. King
*Assistant Examiner*—Jerome DeLuca
(74) *Attorney, Agent, or Firm*—Irving Keschner

(57) ABSTRACT

An adjustable keyboard or workstation tray supported by a pair of articulating arms that are linked together in key locations by torsion tubes. The assembly is attached to the bottom horizontal surface of the user's desk or workstation and used from the desk edge it originates from. This assembly has lift assistance through adjustable torsion springs that are incorporated in the six pivot hubs forming the range of motion of the entire assembly and secures the assembly from movement with their normally latched mechanisms. The user changes the elevation of the keyboard tray by grasping the handles and using his/her thumbs to depress the mechanism release triggers. The first release increment will allow only angular adjustment of the keyboard tray itself by releasing only two pivot hubs at the handle subassemblies. Further depression of the trigger to the next increment allows movement of six pivot hubs, thus enabling movement from under the desk to above or any range between.

1 Claim, 8 Drawing Sheets

FIG. 12
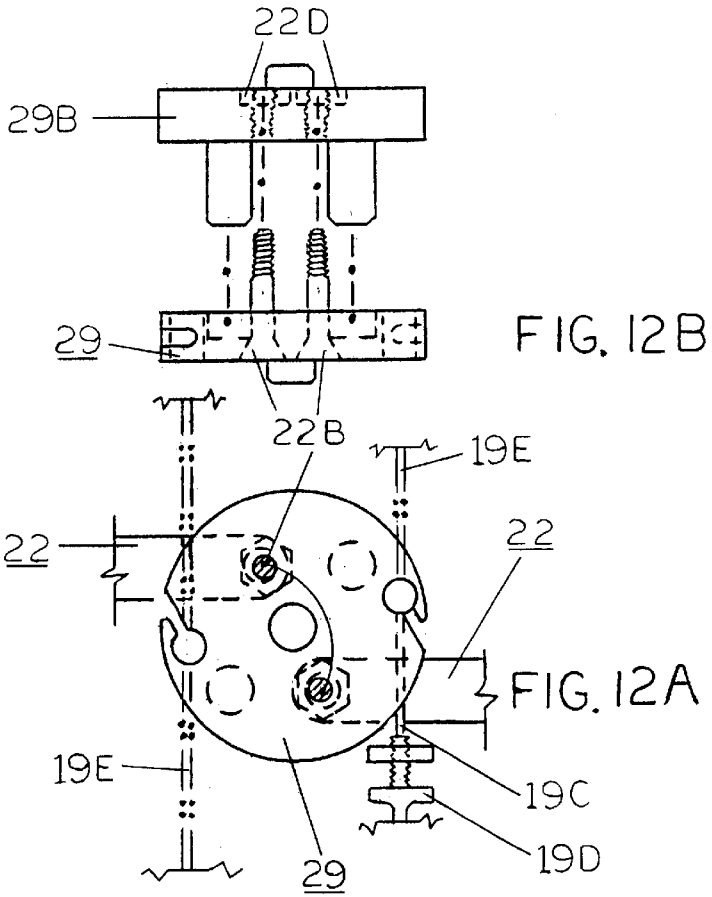
FIG. 12B
FIG. 12A
FIG. 11
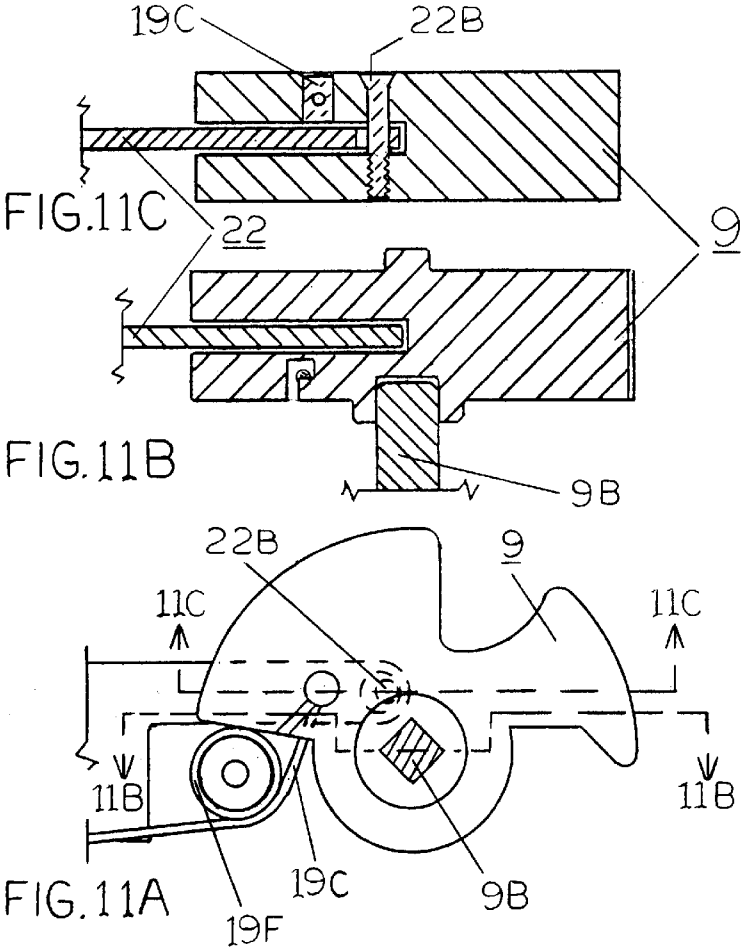
FIG. 11C
FIG. 11B
FIG. 11A

ERGONOMIC WORKSTATION AND KEYBOARD SUPPORT

RELATED APPLICATION

This application is based on provisional patent application Ser. No. 60/091,124 filed Jun. 29, 1998.

BACKGROUND OF THE INVENTION

1. Field of the Invention

The present invention relates to articulated support assemblies that can be retrofitted to existing desks or horizontal surfaces, the assemblies being designed to permit the user to adjust the position of a workstation or keyboard to the most desirable location and store the keyboard or workstation under the desk when it is inactive, thus maximizing work space use.

2. Description of the Prior Art

Devices designed to support keyboards or workstations relative to a desk edge are widely available. Most of these devices maintain a set elevation and merely extend from below the desk where they are stored and the support is attached and are designed primarily for use while the operator of the keyboard is seated at the workstation. These devices have tended to increase their intrusion into the knee-space of the user to obtain a greater degree of motility. In creating motility, they have also generally required more depth of the under desk surface to retract the mechanisms that were designed to create range of motion. The devices were not primarily designed to allow the user to sit or stand at his/her workstation.

U.S. Pat. No. 5,211,367 to Musculus discloses an articulating arm connected to the center and front edge of the keyboard support surface and is capable of accommodating most adjustment conditions from a seated position. The greatest intrusion into the users work area is the knee space that requires straddling the single arm to keyboard interface. In addition, this central arm support method does not create the degree of horizontal stability at the distal areas of the keyboard support. This device also requires large depths under the desk surface for mounting the device. Due to the depth required, many desks that have a knee apron may not be suitable for this assembly, the assembly being based on three adjustment points. In addition, the assembly is not suitable with the operator in a standing position.

U.S. Pat. No. 5,823,487 to Kirchhoff et al discloses a device that uses two support arms that allow the device greater stability at the lateral distal surfaces of the keyboard support and has a total of three pivot points. Two pivot points are under the desk at the distal ends of the keyboard support surface and are arrested by gears with latching cogs. The third pivot point is a generally U shaped torsion bar that the keyboard tray rotates above and around on a horizontal axis. This rotation is arrested by a clutch assembly below the keyboard that allows virtually any angle of keyboard adjustment. It is limited, however, in that the method of connection from the generally U shaped torsion bar that extends from the desk to the keyboard tray uses valuable space in the height of the keyboard tray itself. This does not allow the user to place the keyboard close to a lap position while seated. This device also requires more under desk space than is available in desks with knee aprons. In addition, the production of the device is expensive as it has gears and clutch assemblies that are labor intensive.

U.S. Pat. No. 5,791,263 to Watt et al discloses a work surface that supports an auxiliary device such as a keyboard and is adjustable for vertical movement relative to the work surface or desk it is mounted to. It consists of two sets of parallel arm subassemblies that are horizontally spaced by approximately 80% of the moveable work surface. The generally vertical parallel arms are linked by a horizontal torsion tube for stability on the horizontal plane. This assembly includes a release mechanism that permits arresting the platform at any point within its range of motion, the range of motion being from approximately 4 inches below the desk surface to approximately 6 inches thereabove. Persons of minimal stature can stand or sit while interfacing with the keyboard. However, the '263 system does not have wrist angle adjustment of the keyboard support surface relative to the angle of the users wrist. In addition, the system mechanisms are placed in a manner that is invasive of the knee user space. Further, the '263 system does not retract horizontally under the desk surface, an important requirement of most conventional systems.

Other prior art assemblies are generally less adaptable for ergonomic user adjustment as they are typically less adjustable for height and angle of the keyboard/workstation. Thus, an improved keyboard or workstation support is desired that will address these problems and create the freedom to sit or stand at the workstation.

SUMMARY OF THE PRESENT INVENTION

The present invention provides an improved user workstation which allows the user to adjust the position of a keyboard or workstation to a desirable location and to store the keyboard or workstation under a work desk when inactive to maximize work space.

The present invention further enables the keyboard to be adjusted to a maximum horizontal elevation vertically above the desk or supporting surface or down to the proximity of the floor from a standard elevation desk; the raised elevations allowing the user to stand at the workstation whenever he/she is fatigued from sitting, thereby reducing strain on lumbar regions of the lower vertebrae. In addition, the user can extend the keyboard an increased distance from the workstation monitor than is generally possible with most prior art assemblies and therefore reduce eye strain associated with typical desk applications.

The keyboard angle of inclination is also adjustable to reduce the risk of and alleviate carpal tunnel syndrome and to increase productivity; the assembly of the present invention being easy to install by hooking it to the front edge of the desk and then supports itself from the floor while alternate telescoping legs or screws are installed. The assembly has the capacity to be retrofitted to desks with knee aprons due to a minimal depth required with the six pivot point assembly provided.

The present invention thus provides users with a more active workstation that only requires the computer monitor be elevated approximately 5 degrees above level eyesight at the top of the monitor. With this position, the user can either sit or stand while comfortably viewing the monitor. A keyboard support tray supported by two articulated arm assemblies that are joined with their opposite arm members with torsion tubes and adjusted primarily at six pivot points/hubs is also provided. The components of the assembly are preferably formed from polystyrene, unless nylon or steel is specified. The six pivot points are essential for creating maximum motility with two support arms that afford maximum lateral distal stability of the keyboard platform with minimal intrusion into the desk depth enabling retrofitting into desks with aprons. The two articulating arm assemblies are linked in the center of the front by the keyboard and workstation support platform and in the rear by bracket assemblies that attach it to the horizontal surface that it extends from the desk, the mounting brackets transferring load and finding their proper mounting location under the horizontal surface by means of vertically adjustable angle brackets that hook onto the top edge of the horizontal surface and wrap around to the bottom.

The entire device is controlled by means of two rotating trigger mechanisms that are linked together by a square steel bar. As the six pivot and release mechanisms are controlled by the trigger assembly, any movement desired is controlled from these two locations. The pivot points also include torsion springs of appropriate grade and gauge to allow for range of movement while assisting the lift of the entire assembly including the keyboard and mouse it supports. The springs are adjustable as they can be secured to the appropriate holes in the assembly housing to produce either positive or negative torsion to suit the direction of force and intensity required. The mouse tray is placed in a manner that permits the user the most convenient access thereto, typically at the keyboard elevation and as close as possible to the keyboard itself.

DESCRIPTION OF THE DRAWING

For a better understanding of the invention as well as other objects and further features thereof, reference is made to the following description which is to be read in conjunction with the accompanying drawings wherein:

FIG. 11A shows the proximal side of a release trigger mechanism removed from subassembly with its related control interfaces;

FIG. 11B is a cross-sectional view illustrating the bottom cross-section mechanism 9 and the cross-sectional view of FIG. 11C is the top cross-sectional view of mechanism 9;

FIG. 12A shows a relay mechanism from its distal side view and

FIG. 12B is the top exploded view of the relay mechanism with the distal face down.

DETAILED DESCRIPTION OF THE INVENTION

Figure 1:
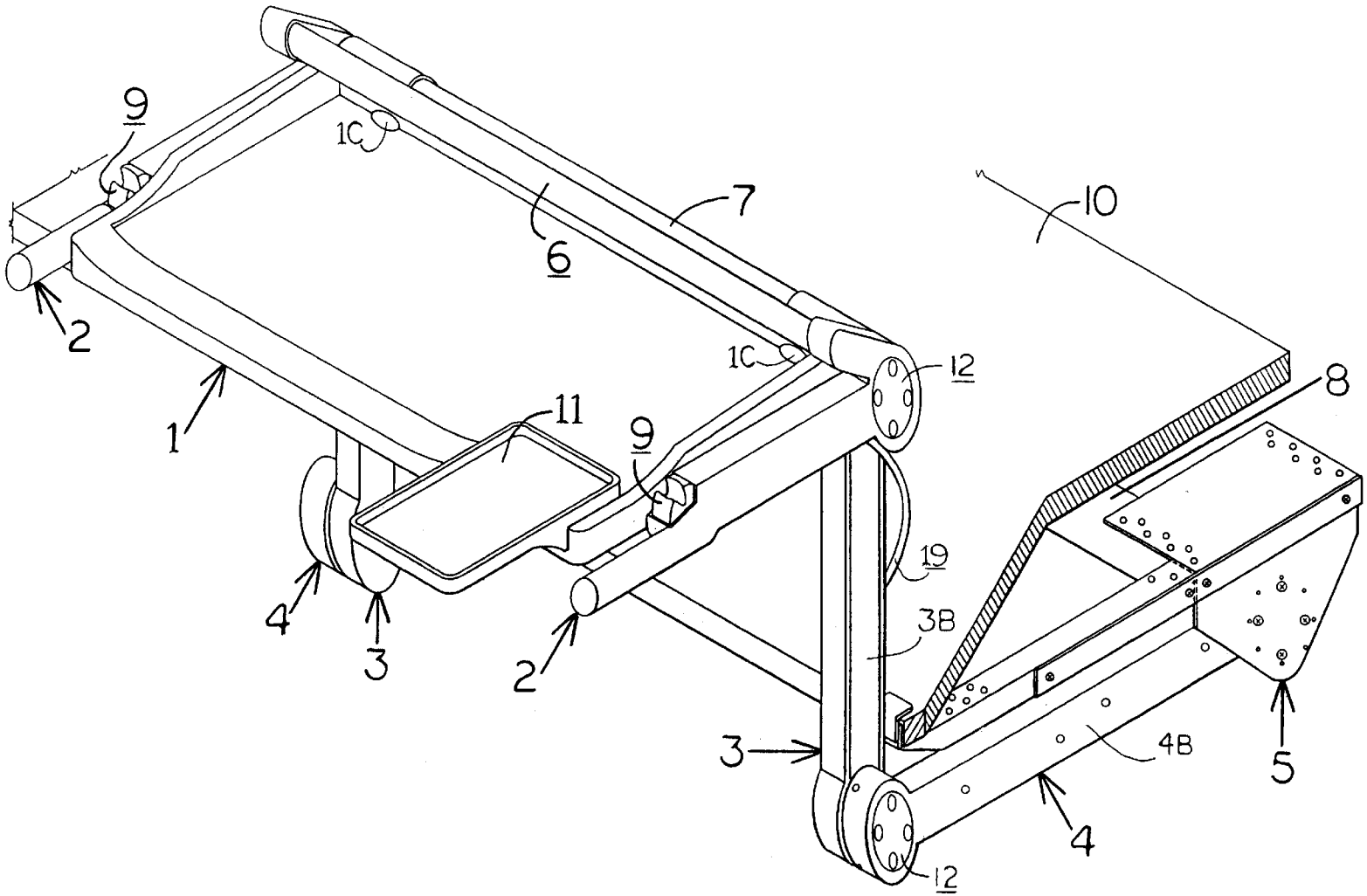
FIG. 1 is a perspective view of the workstation support of the present invention.
Figure 2:
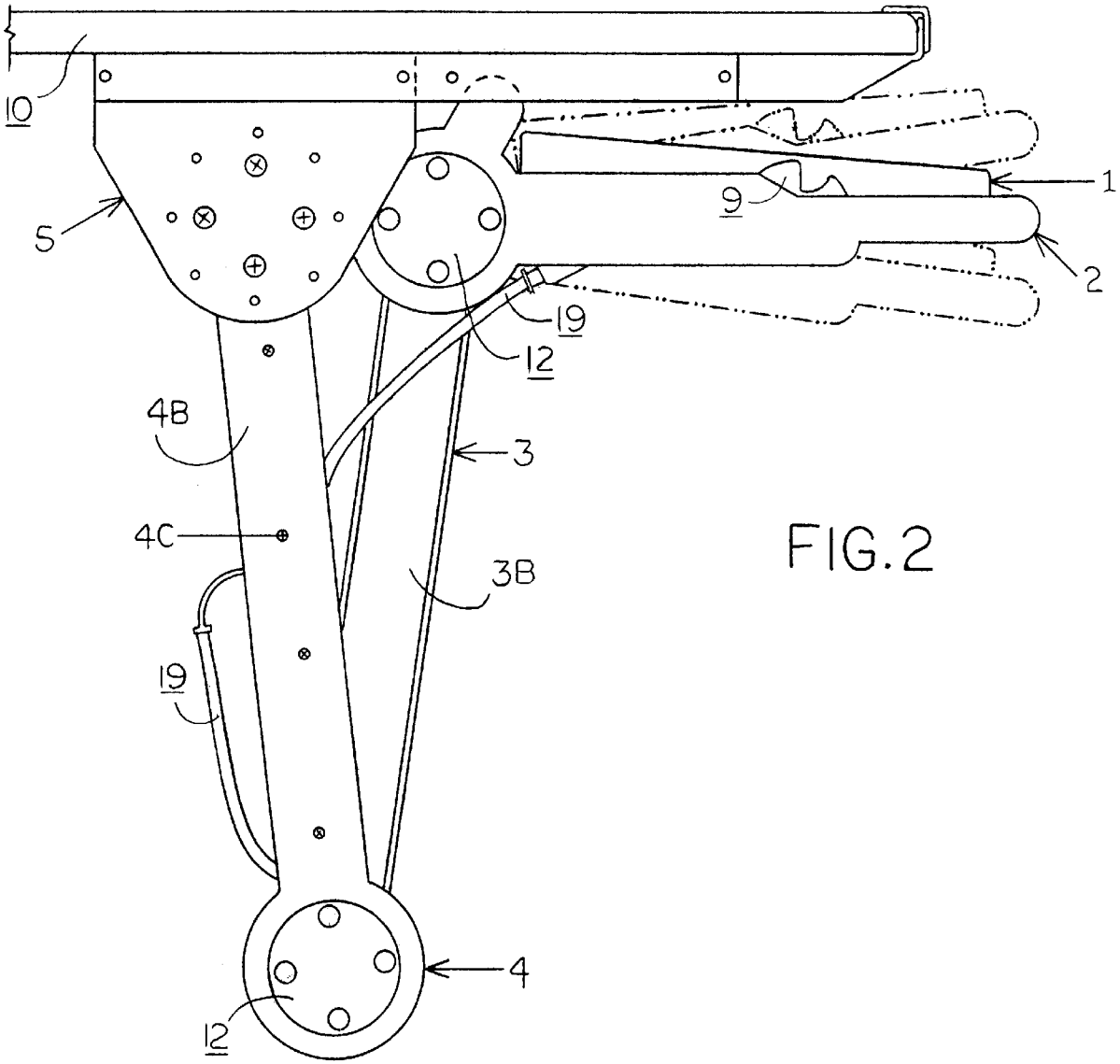
FIG. 2 shows right side elevational view of the support shown in FIG. 1 when stored under a desk.
Figure 3:
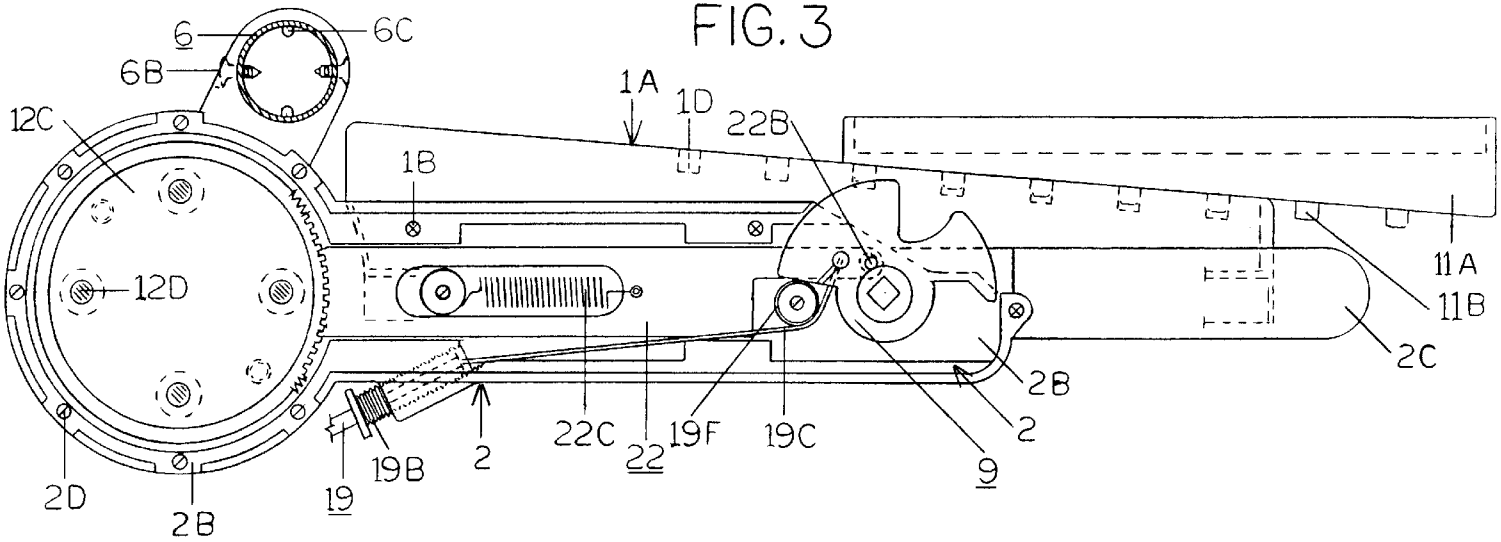
FIG. 3 shows a right hand side view of the support shown in FIG. 2 with its cover removed.
Figure 4:
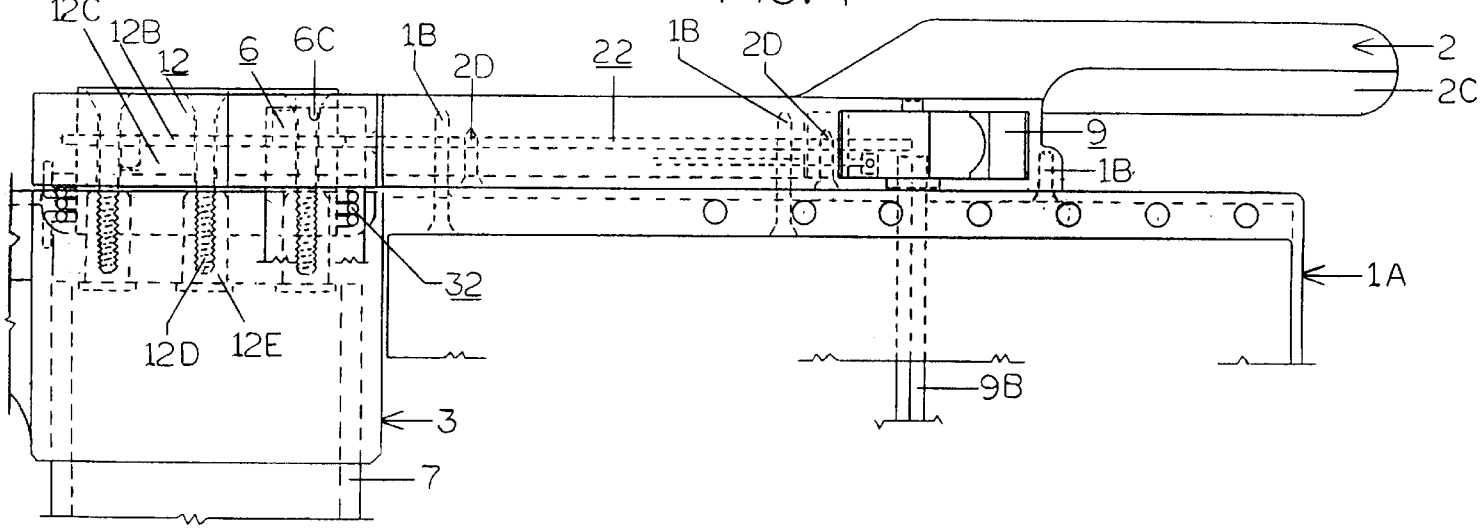
FIG. 4 is a top view of the right hand side of the support shown in FIG. 2.
Figure 5:
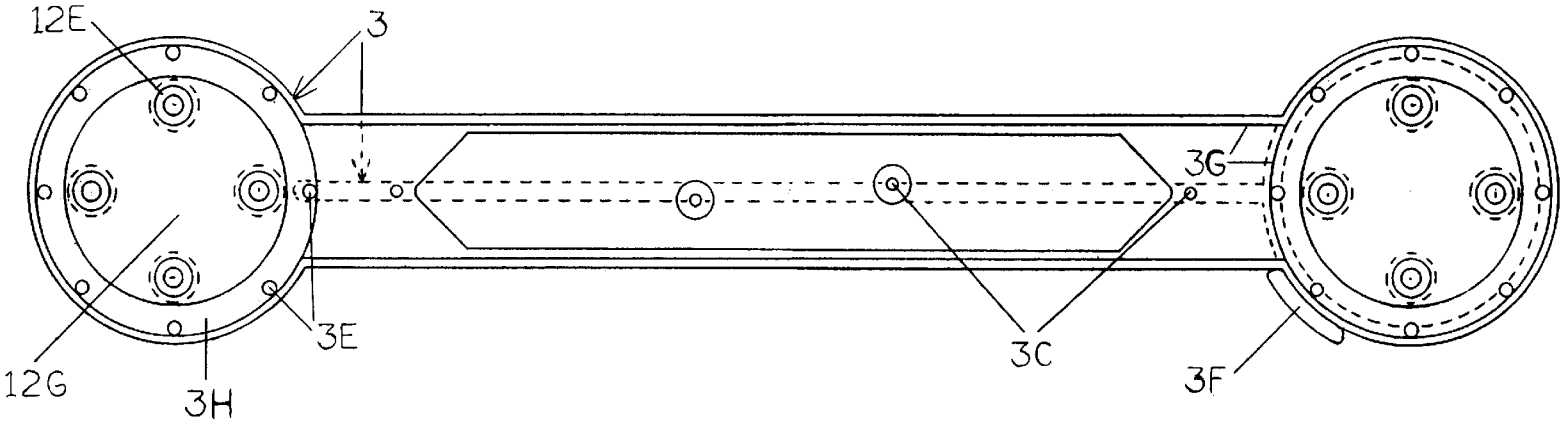
FIG. 5 is a side view of a central arm subassembly with the cover plate removed.
Figure 6:
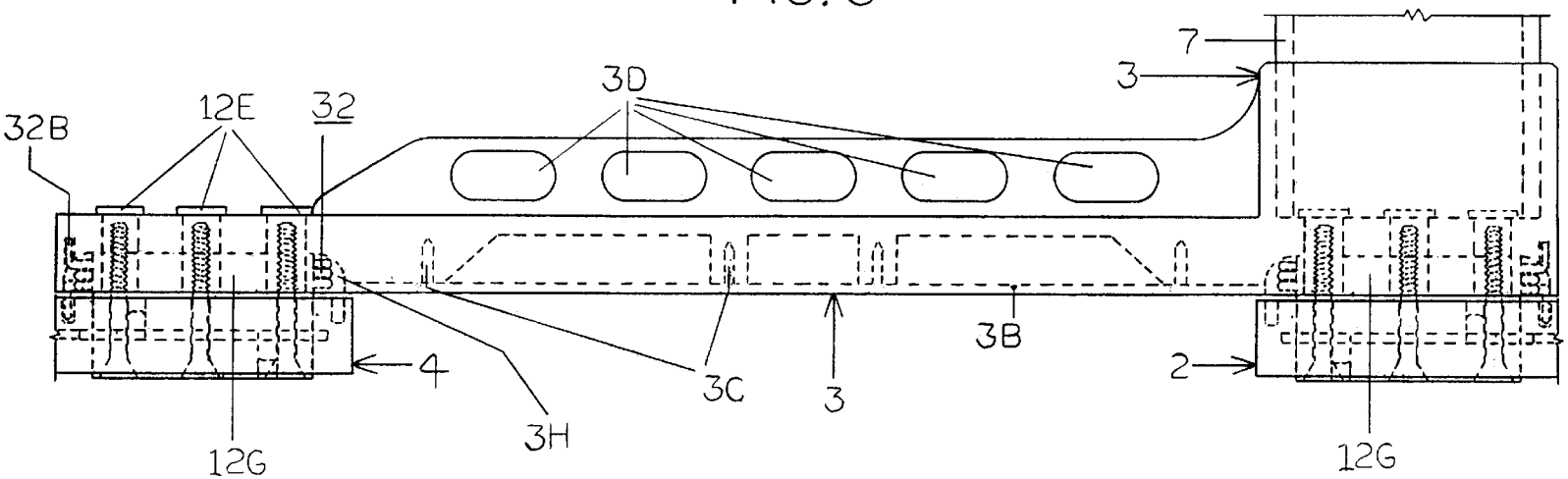
FIG. 6 is a top view of subassembly shown in FIG. 5.
Figure 8:
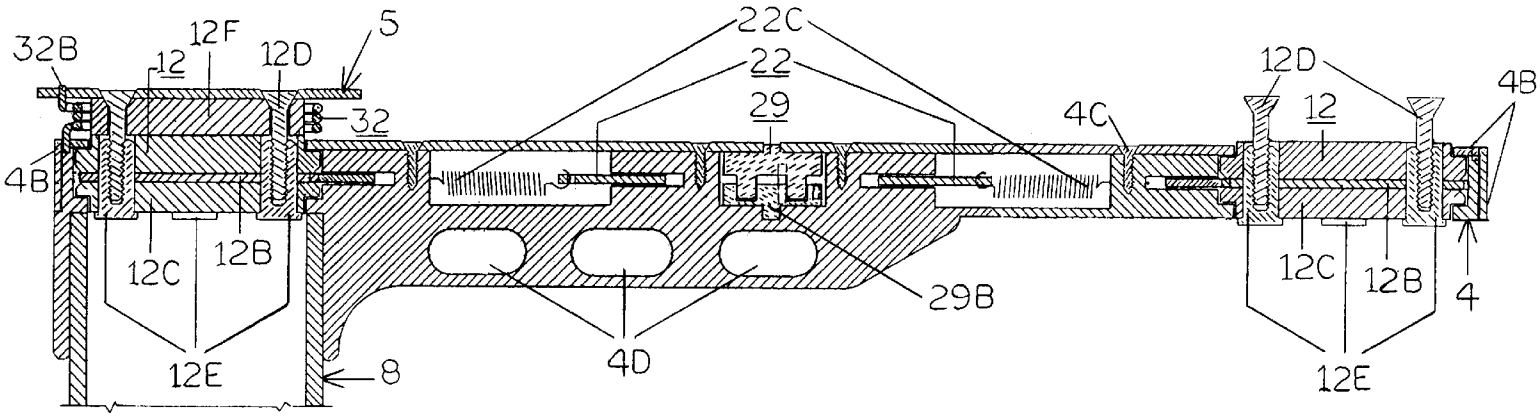
FIG. 8 is the cross-sectional view of the subassembly.
Figure 9:
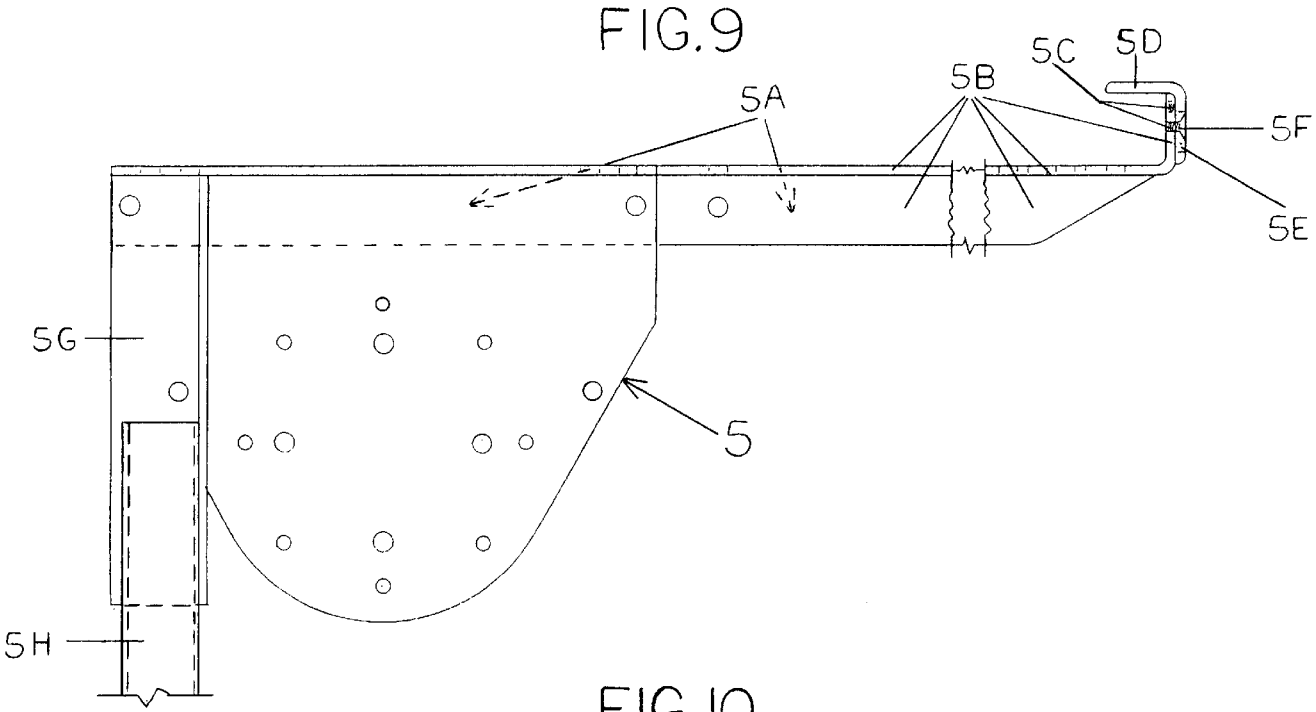
FIG. 9 is the proximal side view of the right hand subassembly.

Referring now to FIGS. 1–4, the front rail of keyboard tray support subassembly 1 or alternative tray 1A is such that it may be vertically as close as ⅛" on the posterior edge of the front rail in relation to the general surface supporting the keyboard or workstation so that a generic type gel wrist pad may be supplied that will conform to the keyboard and the ⅛" lip thus preventing the gel wrist pad from sliding off of the support shelf. The mouse tray 11 or alternate mouse tray 11A are located to the right side of the keyboard tray and are adjustable by pegs 11B protruding from the mouse tray that insert into sockets 1D on the keyboard tray to receive the mouse tray as shown in FIG. 3. All computer control cables travel out of the keyboard tray 1 through computer cable ports 1C where they follow a path as they are channeled through proximal central arm rib holes 3D and proximal primary rib holes (three each) 4D as illustrated in FIGS. 6 and 8 thus being routed to the rear of the horizontal surface that the entire assembly is mounted on.

Figure 7:
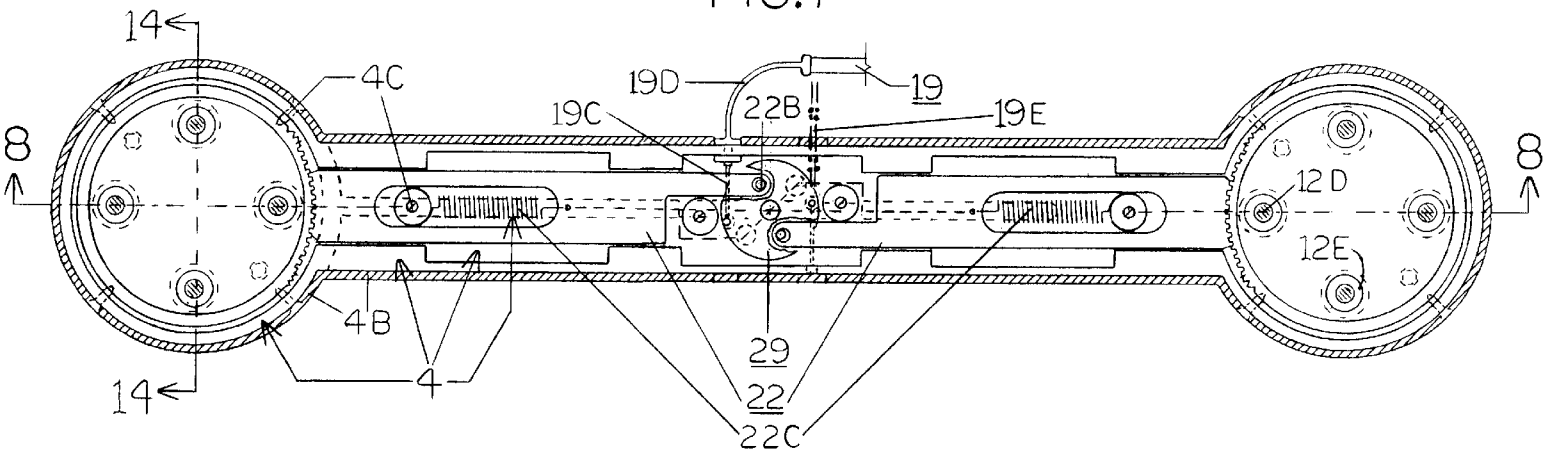
FIG. 7 is the distal view of the right hand subassembly with its cover plate removed.
Figures 13, 14:
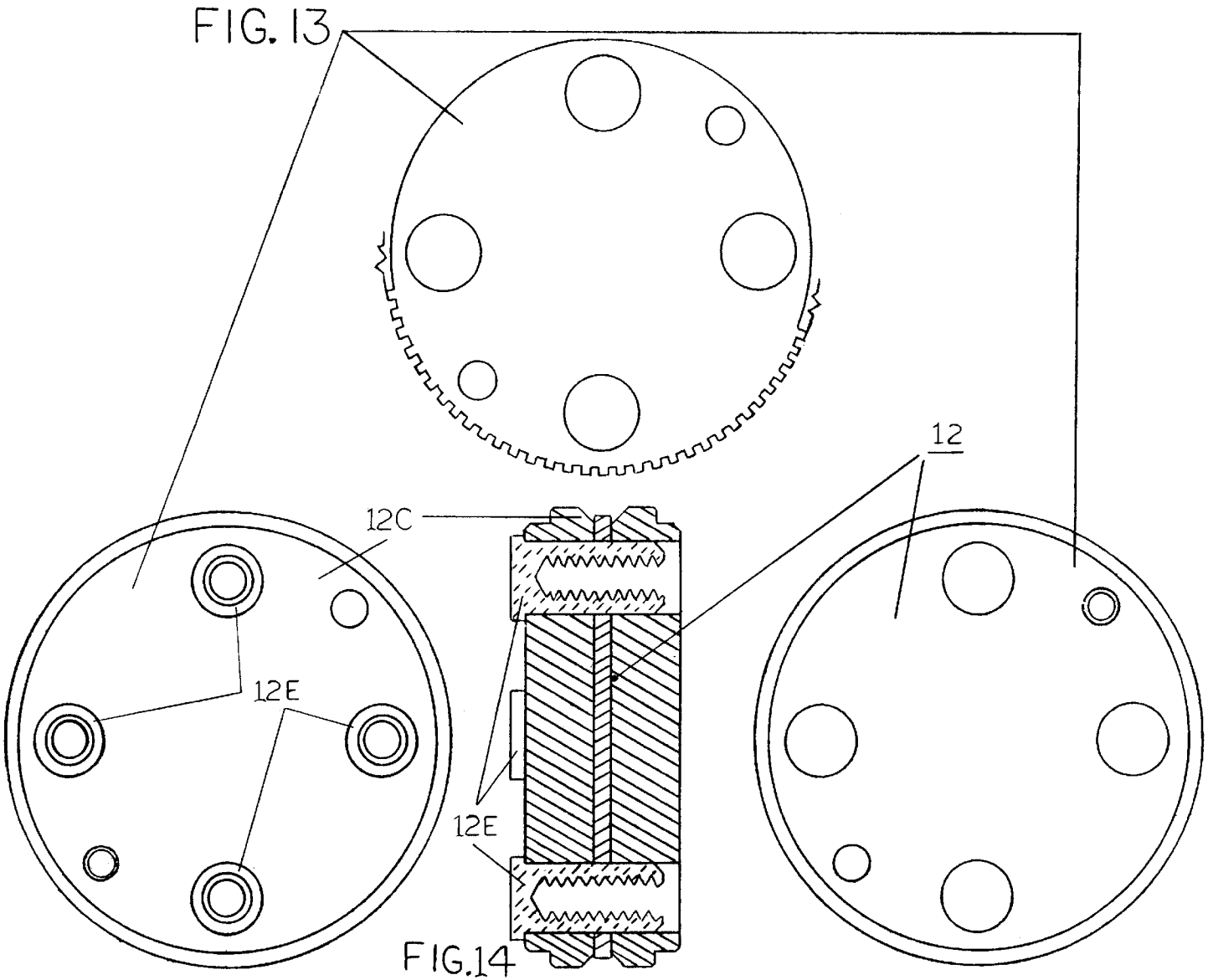
FIG. 13 shows the latch cog disk with typical face of steel plate.
FIG. 14 is a cross-sectional view along line A—A of FIG. 7.

The primary user interface for changing the position of the tray is by means of a pair of handle subassemblies 2 of which the handle is completed by snapping proximal handle section 2C into its barbed receptacle and latch release triggers 9 (nylon) that are horizontally linked by extension 9B shown in FIGS. 1, 2, 3 and 11. By depressing the triggers partially the first two pivot points 12 located at the rear of the keyboard hub will be disengaged from their normally latched positions allowing the angle of the keyboard to be adjusted in approximately four degree increments. This is done through steel latching bar pivot screw 22B that interfaces from the trigger 9 to the steel latch bars 22 that are typical throughout all six pivot points. These latch bars and the steel latch disks 12B are of appropriate gauge and quality to facilitate being produced by steel stamping methods. These parts are stamped so that they will be more economical to produce than typical cut gears and will have straight cut teeth to prevent involuntary disengagement that could occur with conventional bevel cut gear teeth. Steel disks 12B are encapsulated by polystyrene bushings 12 (distal bushing for latch hub assembly) and 12C (proximal bushing disk for latch hub assembly) as shown in FIGS. 13 and 14, the bushing key keep together with post 2 [correct?] and sockets that protrude from the steel disks and fasten together with other subassemblies by means of threaded sleeve inserts (four for each hub assembly) 12E and ¼" bolts 12D (four for each hub assembly) that may also pass through any other bushings used connect to respective subassemblies. The disk assemblies rotate within openings in the main subassemblies in the rabbit type groove on the distal faces of the disks, the proximal face of the disks being beveled to cause the latching bars 22 (two each primary arm subassembly, one each handle subassembly) to settle into the teeth of disks 12B. The latch bars are held in their normally latched position by means of latching bar return springs 22C that pull the latching bars toward the latch disks. As the latch release triggers 9 are depressed to the second release position they disengage all six pivot points allowing both of the articulating arms to move to the desired user position. This second release is accomplished as triggers 9 pull cable assembly 19 as shown in FIG. 3 that is adjusted for tension at threaded cable assembly adjustment sleeve 19B that adjusts the connection of cable housing assembly 19 to the subassembly body 2. The cable assembly is then channeled through the proper holes 3D in the proximal side of the housing assembly 3, shown in FIG. 6. From there the cable housing 19 joins right angle pipe 19D for the cable assembly. As the release cable 19C terminates at the control relay assembly 29, assembly 29, as shown in FIGS. 7, 8 and 12, then activates the four latching bars 22 and latching disks 12B contained in the pair of primary arm subassemblies 4.

The phantom lines 19E represent a port area that continuing accessory cables may be located for releasing latching mechanisms for a pivotal support option that will allow the entire assembly to pivot to either side.

The solid component structural features and pivotal connections employed in the present invention will now be set forth. The handle pair of subassemblies 2 shown in FIGS. 1, 3 and 4 encase latching disks 12, 12B and 12C due to the proximal handle subassembly cover plate 2B being securely fastened by screws 9 into fastener location holes 2D the proximal cover plate (nine each) to complete the hub. To prevent tray 1 from being distorted, a torsion tube 6 is connected between the pair of subassemblies 2. This torsion tube preferably comprises 1" light wall steel tubing (commonly referred to as EMT conduit) that is generally used for electrical conduit. This steel is finished to either match or contrast the primary assembly color. The tube 6 is vertically notched ⅛" at the top and bottom of both ends. As the tube is seated into the socket created for it in subassembly 2, it engages the torsion tube notch key-way 6C by means of protrusions into the socket cavity and is further secured by handle torsion tube screws 6B. Tray 1 is attached to handle 2 by three screws 1B into housing 2 thus encapsulating connecting rod 9 [correct?] between handle assemblies 2 and through a channel in the bottom of keyboard tray 1.

FIGS. 1, 2, 5 and 6 illustrate central arm subassembly 3, the body thereof comprising two identical U-shaped distal channels with two radii ends and a central rib on its proximal side that has five holes 3D formed therein that are either created at body forming or stamped out after the body has been formed. Holes 3D allow cables to be supported with the arm of the assembly, the central arms also having sockets that receive central arm torsion tube 7, the tube comprising three inch ABS plastic pipe that is glued into the sockets to form a diaphragm for load stability. The central arm at its radii ends contain recess 3H for purpose of receiving torsion springs 32. Also located in the recess are central arm hub bushings 12G to complete the disk connections to the other subassemblies. Handle assembly stop 3F is attached to the main body and stops the handle assembly 2 at 90 degrees when measured from the main body of arms 3. The purpose for this stop is that it enables the user to resist the lift force of the torsion springs that lift the complete assembly at the bracket assembly connection 5 while returning the complete assembly to its under desk position. The distal cover plates 4B partially encapsulates the arm 4 on both radii ends and the central portion of the arm but do not encapsulate the proximal face of arm 4. The cover plate snaps into place by means of barbed studs on the internal side of the cover plates that snap into the four cover holes plate snap receptacles, or holes 3C in the central arm 3.

Referring to FIGS. 1, 2, 7 and 8, the primary arm subassembly 4 also consists of two identical arms that are joined together by primary arm torsion tube 8 at the rear and connect to central arms 3 at the front disk set hubs 12. The center of the primary arms is a u-shaped channel distally with a proximally central rib extending approximately eighty percent of length of the central channel beginning at the socket where the torsion tube 8 is bonded. The rib stops in the direction of end that is most distal to the torsion tube 8 as this is where the central arm 3 will butt against the rib of subassembly 4 as the handle radii hub 2 and the radii hub 4 butt together. This end location for the rib will permit maximum rib reinforcement while maintaining identical primary arms 4. The entire perimeter and distal side of the primary arm 4 are encased in the distal primary arm cover plate 4B. These cover-plates encapsulate the hubs 12 and reinforce the balance of the arm. The covers are fastened in some locations such as the distal primary cover plate fastener locations 4C and the end radii, the straight perimeter of the proximal side. The holes 4D in the rib 4 are similar to holes 3D in their fabrication and purpose. As the primary arm subassembly connects to the bracket subassembly 5, it is separated by polystyrene bushings 12F that will be of sufficient width to allow the appropriately gauged torsion spring 32 to operate comfortably.

Figure 10:
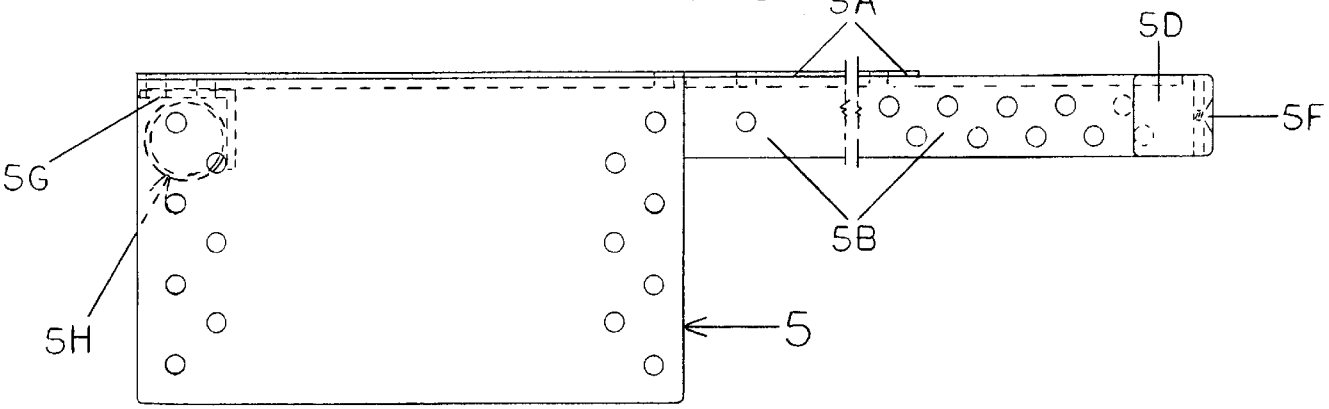
FIG. 10 shows the top view of the subassembly shown in FIG. 9.

FIGS. 1, 2, 9 and 10 illustrate the mounting bracket subassembly that comprises two steel right angle brackets 5 of sufficient gauge to permit lateral reinforcement by stamping gussets into the right angle bend of the steel. Centrally located on the bracket are sets of holes in a circular formation, the set of four holes with the smallest diameter permits type bolts 12D to connect the mounting bracket to the primary arm hub with the primary arm to mounting bracket bushing 12F between the two subassemblies. The larger diameter set of holes receive the ends 32B of torsion springs that are bent at the ends to facilitate connection to various subassemblies. The primary bracket 5 connects to the pair of angle steel load extension and mounting locator angle brackets 5B. The connection between these is reinforced by a flat steel bracketing strap 5A bolted through both brackets 5 and 5B. The distal end of bracket 5B is cut and bent at a right angle to facilitate locating the entire assembly depth relative to the leading edge of the desk or workstation. Two threaded holes 5C are shown in the angle steel bracket 5B at its right angle end. Adjustable angle cap 5D contains an elongated slot that is countersunk to receive angle cap adjustment lock screw 5F. The relationship between the screw that attaches to 5B and elongated countersunk slot 5E permits adjustment to different desk surface thickness. An additional or optional set of brackets 5D and bushing blocks may be provided to facilitate mounting to desks that contain spoons that extend below the bottom edge of the primary horizontal desk or workstation surface. As the assembly is hooked to the front of the horizontal surface it can be attached by screws through the holes in the top of the brackets 5 and 5B as seen in FIG. 10. A bolt may be provided as an option as angle leg connector 5G and telescoping leg 5H suggest a steel angle bracket with a telescoping leg welded to it, the pair of telescoping legs then being extended to the horizontal floor surface to support the entire assembly.

Additional system components are noted hereafter with its identifying reference numeral:

| Ref. No. | Component |
|---|---|
| 1B | keyboard fastening locations - three each |
| 1C | computer cable ports |
| 3B | distal central arm cover plate |
| 3E | torsion spring receiver holes |
| 3F | handle subassembly stop |
| 3G | cover plate extremities |
| 9B | trigger linkage |
| 10 | desktop or horizontal workstation platform |
| 19F | steel idler sleeve |
| 22 | steel latching bars - two each primary arm subassembly, one each handle subassembly |
| 22D | control relay pivot point nuts - two each relay |
| 29 | distal control relay disk |
| 29B | proximal control relay disk |
| 32B | torsion spring end connections |

The present invention allows the user to easily reposition the keyboard tray/workstation platform by disengaging the normally closed latching mechanisms while holding handle 2 and pressing a trigger release 9 and then moving the tray to the desired position with very minimal effort as the assembly has torsion springs 32 to carry loads. The mechanisms can be built in a manner that will allow the keyboard tray angle to be adjusted in increments of approximately 4 degrees or less. The six pivot points/hubs 12 are used to increase the ease of adjustment that is necessary to influence the user to move from the desk to standing elevation at any time within approximately 1–3 seconds.

Further, the present invention creates an efficiently manufactured assembly that will allow the keyboard or workstation user maximum motility from sitting or standing positions with relative ease and minimal loss of work time and with minimal impact to the bottom horizontal surface area of the desk or table that is the primary workstation. This arrangement increases user health and alertness due to activity while used in the standing position.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. An articulated support assembly adapted for adjustably supporting a computer keyboard or workstation on a primarily horizontal tray, the tray's normally unused position below the horizontal surface to which it is mounted horizontally extendable and raised to positions below and above the desk surface sufficiently to permit substantially any height of user to stand or sit at the desk or workstation in proper ergonomic positions, said support comprising:

first and second attachment members adapted to be attached to the bottom surface of the horizontal support member and positioned relative to the front edge with members that adjust to the vertical thickness of the horizontal support member;

a generally U shaped subassembly consisting of two primary elongated arm members joined by a torsion tube and having latches at the four corners of the subassembly, the latches being controlled at two central locations by cable coupled to a trigger release mechanism;

second generally U-shaped subassembly consisting of elongated central arms linked together by a torsion tube has four fixed attachment points at its extreme four corners that connect to two rotating hubs from the primary subassembly and two rotating hubs from the handle subassembly;

a pair of handle subassemblies that contain two rotating hubs and two trigger release mechanisms axially joined that permit the user to release all pivot points from their normally latched positions; and a keyboard tray or workstation platform that has a primarily horizontal lateral surface for the support of a computer keyboard or any desired working platform, the platform being adjustable in relation to its horizontal angle as relating to the wrist angle of the user.

* * * * *